US008187432B2

(12) United States Patent
Yamamoto et al.

(10) Patent No.: US 8,187,432 B2
(45) Date of Patent: May 29, 2012

(54) ANODIZING APPARATUS

(75) Inventors: Tomoharu Yamamoto, Shizuoka-Ken (JP); Hiroomi Tanaka, Shizuoka-Ken (JP)

(73) Assignee: Suzuki Motor Corporation (JP)

( * ) Notice: Subject to any disclaimer, the term of this patent is extended or adjusted under 35 U.S.C. 154(b) by 709 days.

(21) Appl. No.: 12/316,869

(22) Filed: Dec. 17, 2008

(65) Prior Publication Data

US 2009/0166190 A1 Jul. 2, 2009

(30) Foreign Application Priority Data

Dec. 28, 2007 (JP) ..... 2007-339734

(51) Int. Cl.

| | |
|---|---|
| ***C25B 9/00*** | (2006.01) |
| ***C25D 17/00*** | (2006.01) |
| ***B23H 7/04*** | (2006.01) |
| ***B23H 7/14*** | (2006.01) |
| *C23F 1/00* | (2006.01) |
| *C25D 21/12* | (2006.01) |
| *C25D 11/04* | (2006.01) |

(52) U.S. Cl. ..... 204/242; 204/672; 204/228.1; 204/196.17; 204/194; 204/298.03; 205/324; 205/83; 156/345.19

(58) Field of Classification Search ..... None
See application file for complete search history.

(56) References Cited

U.S. PATENT DOCUMENTS

| | | | | |
|---|---|---|---|---|
| 3,968,020 | A * | 7/1976 | Nagano et al. | 204/203 |
| 4,390,407 | A | 6/1983 | Mori et al. | |
| 4,517,059 | A * | 5/1985 | Loch et al. | 205/83 |
| 4,639,302 | A * | 1/1987 | Everett | 204/258 |
| 5,614,076 | A * | 3/1997 | Brophy et al. | 205/666 |
| 2002/0153097 | A1 * | 10/2002 | Basol et al. | 156/345.11 |
| 2006/0037866 | A1 * | 2/2006 | Yamamoto et al. | 205/324 |
| 2009/0236228 | A1 * | 9/2009 | Yamamoto et al. | 205/83 |

FOREIGN PATENT DOCUMENTS

| | | | |
|---|---|---|---|
| CN | 2463404 | Y | 12/2001 |
| DE | 2853609 | A1 | 6/1979 |
| DE | 3135747 | A1 | 4/1982 |
| GB | 2012305 | A | 7/1979 |
| JP | 2002-47596 | A | 2/2002 |
| JP | 2006-83467 | A | 3/2006 |

OTHER PUBLICATIONS

Office Action from German Application No. 102008063187.6-45, dated Aug. 10, 2010.

Office Action from corresponding Chinese Application No. 200810187349.5, dated Mar. 9, 2010.

* cited by examiner

*Primary Examiner* — In Suk Bullock
*Assistant Examiner* — Jennifer Wecker
(74) *Attorney, Agent, or Firm* — Lerner, David, Littenberg, Krumholz & Mentlik, LLP

(57) ABSTRACT

An anodizing apparatus for forming an anodized film on the surface of a workpiece (11) made of aluminum or aluminum alloy includes a treatment tank (1) for containing an electrolytic solution, a cathode plate (2) disposed in the treatment tank, a supporting means (3) for supporting the workpiece so as to be immersed in the electrolytic solution, and a power supply (4) for continuously or intermittently applying a short-period bipolar or unipolar pulse voltage or an alternating voltage to between the workpiece and the cathode plate. The cathode plate (2) is arranged in a crosswise direction with respect to the workpiece (11).

10 Claims, 8 Drawing Sheets

ANODIZING APPARATUS

FIELD OF THE INVENTION

The present invention relates to an apparatus for anodizing a workpiece made of aluminum or aluminum alloy.

BACKGROUND OF THE INVENTION

Conventionally, members made of aluminum or aluminum alloy, such as a variety of exterior parts and structural parts including pistons and cylinders of internal combustion engines and hydraulic and pneumatic pistons and cylinders, have been anodized to form an anodized film (anodic oxide coating) on the surfaces of the members for the purpose of improving the corrosion resistance and wear resistance or coloring.

For this anodizing treatment, for example, as disclosed in JP2002-47596A, electrolytic treatment is performed by applying DC voltage, AC voltage, AC and DC superimposing voltage, or pulse voltage to between a workpiece (anode) and a cathode in the state in which the workpiece is immersed in an electrolytic solution. The present inventors discovered a method for forming a high-quality anodized film at a high speed, without being affected by an alloy component, including a treatment of repeating the anodization by applying positive voltage for a very short period of time and removing charges from the film as disclosed in JP2006-83467A.

In the conventional anodization, it has been thought to be proper for treatment to be performed at a current up to about 3 A per 1 $dm^2$ of the surface area of the workpiece to prevent burning. However, in the treatment method disclosed in JP2006-83467A, the temperature rise is restrained by the removal of film charges, and as a result, a current of 30 A or more per 1 $dm^2$ of the surface area of a workpiece can be supplied in a positive voltage applying period, so that the treatment time can be shortened to a fourth to a fifth of the conventional treatment time.

BRIEF SUMMARY OF THE INVENTION

Although the treatment of repeating the anodization accomplished by the application of positive voltage for a very short period of time and the removal of film charges shortens the treatment time, this treatment poses a new problem described below. As the supplied current increases, a large surface area of the cathode is required to perform the treatment stably as compared with the case of conventional DC anodization and low-frequency alternating current. However, there is naturally a limit to the accommodation space in a treatment tank. Therefore, in a case in which an electrode plate is arranged so that the electrode surface faces the workpiece as in the conventional example, the size of the treatment tank must be inevitably increased.

Generally, in the DC anodization, a phenomenon is seen in which the film thickness of a workpiece decreases in a portion on the side opposite to the electrode. The reason for this is thought to be that whereas a conductive path is formed at the shortest distance in a portion in which the electrode and the workpiece face each other, a long conductive path is formed so as to bypass the workpiece in the portion on the side opposite to the electrode, so that the electrical resistance increases relatively, thereby decreasing the current density. Therefore, in the DC anodization, the electrode plate is generally arranged so as to face to the workpiece in such a manner that the distance between each portion of the workpiece and the electrode surface is constant.

However, in a case in which the cathode is arranged so as to face to the side of the workpiece, the electrode area becomes an area corresponding to a projected area of the workpiece on the side surface of treatment tank. Therefore, unless the size of the treatment tank is increased, it is difficult to increase the substantial electrode area. In particular, for a relatively small part such as a piston, a large number of workpieces are treated at the same time to improve the production efficiency. As the accommodation interval of the workpieces in the treatment tank decreases, the electrode space capable of being allotted to each workpiece decreases, and it is necessary to determine whether the workpiece accommodation efficiency will be decreased or whether the size of the treatment tank will be increased.

Furthermore, if the arrangement is made such that the cathode plate surrounds the workpiece to secure the surface area of cathode plate, the agitation of the treatment solution is hindered, and the cooling capacity against heat generation at the time of anodization decreases, so that there is a fear that a problem of burning or the like may occur. In addition, in the case in which a large number of workpieces is treated at the same time, the treatment state and the film thickness may be varied according to the position of workpiece, which becomes a hindrance to the further increasing of speed and upgrading of quality of anodization.

The present invention has been made in view of the above circumstances, and accordingly an object thereof is to provide an anodizing apparatus in which the surface area of a cathode can be increased without increasing the size of a treatment tank by an efficient arrangement of the cathode, stable and efficient anodizing treatment can be performed, the flow efficiency of a treatment solution and the cooling efficiency of a treatment solution can be improved, and the workpiece can be treated uniformly even in the case in which a large number of workpieces is treated at the same time.

To solve the above problems, the present inventors conducted extensive research, and as a resultant, they obtained a knowledge that in the anodizing treatment in which a short-period bipolar or unipolar pulse voltage or an alternating voltage is applied continuously or intermittently to a workpiece, especially in the treatment in which the anodization accomplished by the application of positive voltage for a very short period of time and the removal of film charges are repeated, even in the arrangement in which the electrode surface of the cathode plate does not face the workpiece, a deviation in film thickness on the surface of workpiece is hardly present, and practical treatment can be performed. As the result, the inventors arrived at the present invention.

The present invention provides an anodizing apparatus for forming an anodized film on the surface of a workpiece made of aluminum or aluminum alloy, including a treatment tank for containing an electrolytic solution; a cathode plate disposed in the treatment tank; a supporting means for supporting the workpiece so as to be immersed in the electrolytic solution; and a power supply for continuously or intermittently applying a short-period bipolar or unipolar pulse voltage or an alternating voltage to between the workpiece and the cathode plate, wherein the cathode plate is arranged in a crosswise direction with respect to the workpiece.

In a preferred mode of the present invention, the cathode plate is arranged in plurality so as to be substantially parallel spaced (FIG. 3), or the cathode plate is arranged on both sides of the workpiece with the workpiece being the center (FIGS. 4 to 6). Alternatively, the cathode plate is arranged in plurality so as to be radial with respect to the workpiece (FIGS. 7 and 8).

Furthermore, in the case in which a large number of workpieces is treated at the same time, it is preferable that the workpiece be arranged in plurality and be supported by a support, and the cathode plates be oriented to the direction crossing the arrangement direction of the workpieces and be disposed substantially in parallel so as to be separated from each other.

Also, in the above-described modes, it is preferable that the anodizing apparatus further include a means for generating a flow of the electrolytic solution in the treatment tank, the flow being directed to the workpiece along the cathode plate.

Since being configured as described above, the anodizing apparatus in accordance with the present invention has operations and effects as described below.

Even in the arrangement in which the electrode surface of the cathode plate does not face to the workpiece, since the cathode plate is oriented to the direction such that the cathode plate crosses the workpiece, a surface substantially opposite to the workpiece is not provided, so that both surfaces of the cathode plate can be utilized as a treatment electrode surface, and therefore the electrode area can be increased effectively. Thereby, even in the case in which the input current is increased, stable and efficient anodizing treatment can be performed.

The above-described arrangement of cathode plate has no effect in anodizing treatment performed by the direct current method or the low-frequency alternating current method. In addition, the current concentrates on a partial surface of a workpiece close to the edge of cathode plate, and excessive oxidation is accelerated, so that there may arise a problem in that unevenness of film thickness, and in turn, burning or the like, occur.

In contrast, in the anodizing treatment in which a short-period bipolar or unipolar pulse voltage or an alternating voltage is applied continuously or intermittently to the workpiece, especially in the treatment in which the anodization accomplished by the application of positive voltage for a very short period of time and the removal of film charges are repeated, the application time of positive voltage is very short, and additionally, the heat generated by anodization is allowed to escape at the time of charge removal and the produced film is restored to an inherent high-resistance state. Thereby, evenness of film thickness is achieved by the movement of a film growth point to an uncoated part or a part in which the film is thin at the time of the next voltage application. Therefore, a problem of unevenness of film thickness, burning, or the like, does not occur. Further more, the electrical resistance at the interface between the cathode plate and the treatment solution decreases in inverse proportion to the increase in electrode area, and the voltage loss decreases, so that a thicker film can be formed.

Even in the arrangement in which the electrode surface of cathode plate does not face to the workpiece, the improvement in the efficiency of anodization itself achieved by the increase in electrode area restrains the occurrence of variations in treatment state and film thickness of parts of the workpiece, so that an even anodized film can be formed in all parts of the workpiece.

Furthermore, even if the electrode area is increased, the periphery of the workpiece is not surrounded by the cathode plate. Therefore, the flow of treatment solution is not hindered, and a treatment solution agitating means can be provided without hindering a path between the cathode plate and the workpiece, so that the cooling capacity against the heat generation of anodization is not decreased.

In the present invention, in a mode in which the cathode plate is arranged in plurality so as to be substantially parallel spaced (FIG. 3), a mode in which the cathode plate is arranged on both sides of the workpiece, with the workpiece being the center (FIGS. 4 to 6), a mode in which the cathode plate is arranged in plurality so as to be radial with respect to the workpiece (FIGS. 7 and 8), and a mode in which the above-mentioned modes are combined, the electrode area can further be increased with respect to the side projected area of the workpiece.

Also, for a large-size workpiece, the arrangement can be made such that the workpiece is surrounded by a large number of cathode plates without hindering the flow of treatment solution, so that an even anodized film can be formed on the whole of the large-size workpiece. Further more, in the case in which a large number of workpieces are treated at the same time, the cathode plates can be arranged evenly with respect to the workpieces arranged in parallel, and a large number of workpieces and cathode plates can be arranged efficiently in the treatment tank.

Also, in the case in which the workpiece is arranged in plurality and is supported by a support, if the cathode plates are oriented to the direction crossing the arrangement direction of the workpieces and are disposed substantially in parallel so as to be separated from each other, the arrangement can be made such that the accommodation interval of individual workpieces and the installation interval of cathode plates shift from each other by a half pitch. Further more, even if the accommodation interval of individual workpieces and the installation interval of cathode plates shift irrelevantly, uniform anodizing treatment can be performed overall.

Further more, in the above-described modes, in a mode in which the anodizing apparatus further includes a means for generating a flow of the electrolytic solution in the treatment tank, the flow being directed to the workpiece along the cathode plate, bubbles formed on the electrode surface are removed by the flow of treatment solution, so that an active treatment solution can be supplied to the workpiece, and thereby anodizing treatment can be performed effectively. In addition, the cathode plate functions as a straightening plate, so that a flow of treatment solution in a constant direction can be formed without separately providing a straightening plate, and also the cathode plate itself can be utilized for cooling of treatment solution or heat dissipation.

The range of the application time of positive voltage allowed by the arrangement of the cathode plate in accordance with the present invention differs according to the required film properties, treatment solution, treatment time, applied voltage, effective area of cathode plate, distance between the cathode plate and the workpiece, size and shape of workpiece, and the like. Since only the application time of positive voltage contributes to the formation of anodized film, the film charge removal time, that is, the time during which the positive voltage is not applied or the time during which a negative voltage is applied is preferably at the necessary minimum, and the bipolar pulse voltage including the film charge removal time during which charges are removed positively by the application of negative voltage is preferable as compared with the unipolar pulse voltage not including the negative pressure application time. However, it seems that depending on the conditions, even for the unipolar pulse voltage, an effect achieved by the increase in electrode area can be anticipated.

Also, negative ions penetrate into a barrier layer of the anodized film at the very early stage of the positive voltage application time and oxidation proceeds, and thereafter the penetration of negative ions is restrained by the negative ions accumulated in the barrier layer and oxidation does not proceed. Therefore, the positive voltage application time is preferably at the necessary minimum. The waveforms of positive voltage and negative voltage are not subject to any special restriction, but a rectangular pulse voltage capable of supplying a large current in a short period of time is preferable.

DETAILED DESCRIPTION OF THE INVENTION

Embodiments of the present invention will now be described in detail with reference to the accompanying drawings.

Figure 1:
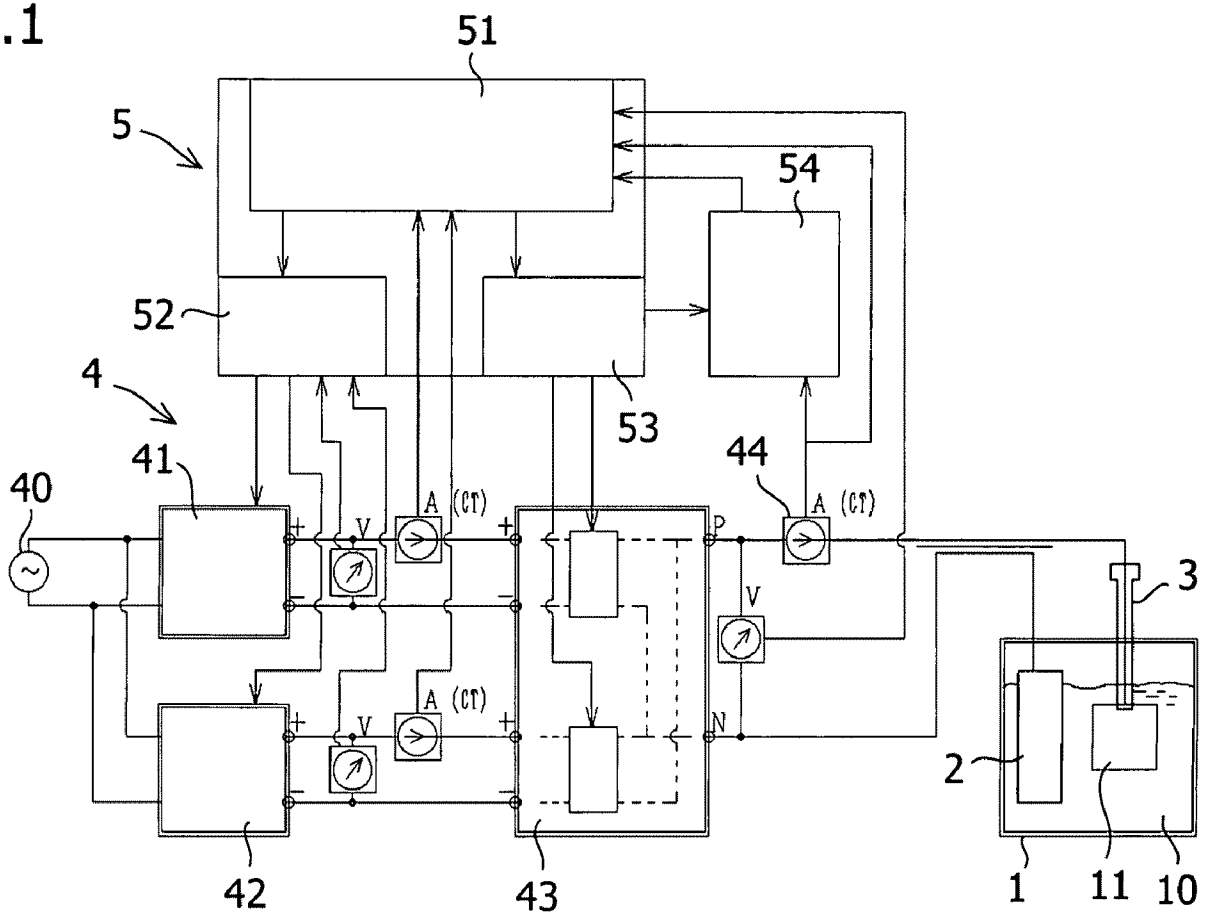
FIG. 1 is a configuration diagram of an anodizing apparatus in accordance with an embodiment of the present invention.

FIG. 1 is a configuration diagram of an anodizing apparatus in accordance with an embodiment of the present invention. In FIG. 1, the anodizing apparatus is mainly made up of a treatment tank 1 for containing an electrolytic solution 10, a cathode plate 2 disposed in the treatment tank 1, a support 3 for supporting a workpiece 11 made of aluminum or aluminum alloy at a position at which the workpiece 11 is immersed in the electrolytic solution 10, a power supply unit 4 for continuously or intermittently applying a short-period bipolar or unipolar pulse voltage or an alternating voltage to between the workpiece 11 and the cathode plate 2, and a control unit 5 for controlling the power supply unit 4.

The power supply unit 4 includes a DC power supply 41 for positive voltage and a DC power supply 42 for negative voltage, which are connected to a primary AC power source 40 of commercial frequency, and an inverter unit 43 for delivering a predetermined pulse voltage or alternating voltage by switching the DC voltage and current supplied from the DC power supplies 41 and 42. The inverter unit 43 includes a switching element such as an insulated gate bipolar transistor (IGBT), a clamping circuit, and a protection circuit, and is controlled by a switching control part 53 of the control unit 5.

The control unit 5 includes a main control part 51 for setting parameters of anodization and controlling the anodization, a voltage control part 52 for the DC power supplies 41 and 42, the switching control part 53 for the inverter unit 43, and a supervisory part 54 for a treatment current. When anodization is started, supplied voltage, film charge removal voltage, treatment time, slow-up time, and treatment mode are input to the main control part 51 in advance.

The slow-up time is the time for raising a voltage to a set input voltage slowly to prevent an excessive current from flowing in the state in which the anodized film is not yet produced at the early stage of anodization.

As the treatment mode, a high-speed treatment mode in which treatment speed has priority, a high-quality treatment mode in which the smoothness of the film surface has priority over treatment speed, an intermediate treatment mode therebetween, and the like can be selected according to the required film properties. The treatment mode is input, for example, by the input of numerical values of percentages, or by a selecting switch. By the selection of these treatment modes, the positive voltage application time and the negative voltage application time (that is, the film charge removal time) in each period of bipolar pulse voltage, distribution thereof in the period, or the setting reference thereof is changed. As the waveforms of positive voltage and negative voltage, a rectangular pulse voltage capable of supplying a large current in a short period of time is suitable.

The optimum setting condition corresponding to each of the aforementioned treatment modes differs according to the size and shape of the workpiece 11, the number of workpieces 11 treated at the same time, and the like. Therefore, an anodization test is conducted prior to the treatment, and arithmetic processing is performed by the control unit 5 based on the time change of current detected by a current detector 44 provided on the anode side, by which the optimum voltage application time corresponding to each treatment mode is determined. Based on the determined optimum voltage application time, the film charge removal time and the distribution in the period are determined. This condition setting process can also be performed during the slow-up time.

As the treatment solution 10, dilute sulfuric acid, oxalic acid, phosphoric acid, chromic acid, and the like can be cited. However, the treatment solution 10 is not limited to the above-mentioned acids, and a treatment solution used for ordinary anodization, such as a diprotic acid bath, a mixed acid bath of a diprotic acid and an organic acid, or an alkali bath, can be used. The alkali bath may contain a metallic compound of an alkali earth metal. Also, the alkali bath can optionally contain borides or fluorides. The material of the cathode plate 2 is not subject to any special restriction, and a cathode plate having been used conventionally for anodization, such as a carbon plate, titanium plate, stainless steel plate, lead plate, or platinum plate, can be used.

The anodizing apparatus in accordance with the present invention is characterized in that the cathode plate 2 disposed in the treatment tank 1 is arranged in a crosswise direction with respect to the workpiece 11 as shown in FIGS. 2 to 9, and adopts a basic mode and some principal modes based on the basic mode. Hereunder, these modes are explained with reference to the drawings.

Figure 2:
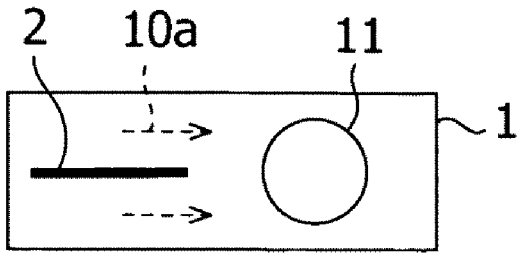
FIG. 2 is a schematic plan view showing a layout of a cathode plate in accordance with a first embodiment of the present invention.

FIG. 2 is a schematic plan view showing a most basic first embodiment of a layout of the cathode plate in accordance with the present invention. In this embodiment, the cathode plate is oriented to the direction such as to cross the central axis of the workpiece 11 on one side of the workpiece 11. By this arrangement of the cathode plate 2, both surfaces of the cathode plate 2 can be utilized as a treatment electrode surface. Therefore, as compared with the conventional layout in which the cathode plate faces to the workpiece, the electrode area doubles even in the case in which comparison is made simply in terms of plane.

Moreover, the cathode plate 2 occupies only a portion corresponding to the thickness thereof of the side projected area of the workpiece 11, so that an agitating means (described later) for the treatment solution can be installed in spaces at both sides of the cathode plate 2 without hindering a path between the cathode plate 2 and the workpiece 11.

Thereby, if a flow 10*a* of treatment solution directed to the workpiece 11 along the electrode surface of the cathode plate 2 is generated, bubbles formed on the electrode surface are removed by the flow 10*a*, so that the treatment solution 10 can be activated and supplied to the workpiece 11, and thereby anodization can be accomplished effectively. In addition, the cooling of the workpiece 11 is promoted by the flow 10*a* of treatment solution, and the cooling efficiency against the heat generation of anodization is improved, so that the burning and unevenness of film thickness caused by the local temperature rise of the workpiece 11 can be prevented from occurring.

Further more, by the characteristic that the cathode plate 2 occupies only a portion corresponding to the thickness thereof of the side projected area of the workpiece 11, a layout in which a plurality of cathode plates 2 are arranged in parallel on one side of the workpiece 11 so as to be separated from each other can be adopted.

Figure 3:
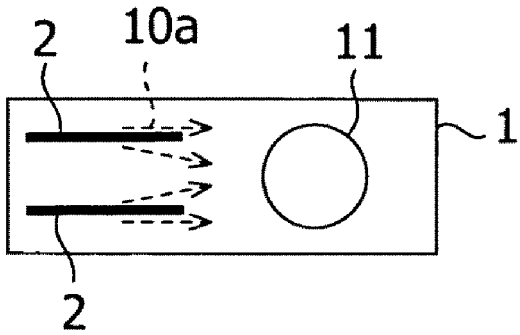
FIG. 3 is a schematic plan view showing a layout of a cathode plate in accordance with a second embodiment of the present invention.

FIG. 3 shows a second embodiment in which two cathode plates 2 are arranged in parallel on one side of the workpiece 11 so as to be separated from each other. By this arrangement of the two cathode plates 2, as compared with the conventional layout in which the cathode plate faces to the workpiece, the electrode area quadruples even in the case in which comparison is made simply. Moreover, the effect achieved by the flow 10*a* of treatment solution is almost the same as that in the above-described first embodiment, and the flow straightening effect that is given to the treatment solution 10 by the cathode plate 2 is rather improved.

Figure 4:
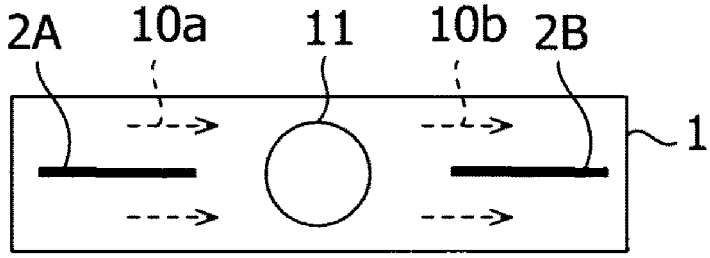
FIG. 4 is a schematic plan view showing a layout of a cathode plate in accordance with a third embodiment of the present invention.
Figure 5:
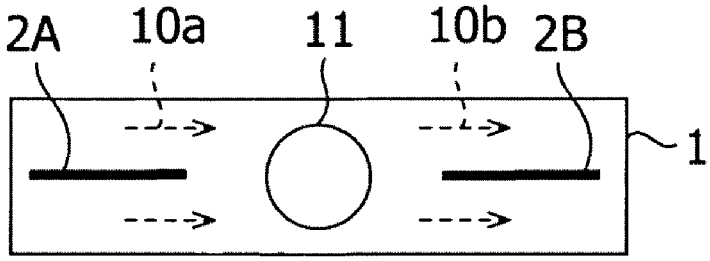
FIG. 5 is a schematic plan view showing a case in which the flow of a treatment solution is different in a layout of a cathode plate in accordance with a third embodiment of the present invention.

FIGS. 4 and 5 show a third embodiment in which two cathode plates 2A and 2B are disposed on both sides of the workpiece 11 with the workpiece 11 being held therebetween. In the mode shown in FIG. 4, there are generated flows 10*a* and 10*b* of treatment solution that are directed from both sides to the workpiece 11 along the two cathode plates 2A and 2B. In this case, the treatment solution arriving at the workpiece 11 is circulated to the upper part or the lower part (or both the side parts) of the treatment tank 1. On the other hand, in the mode shown in FIG. 5, there are generated flows 10*a* and 10*b* of treatment solution that are directed to the workpiece 11 along one cathode plate 2A, and flow along the other cathode plate 2B after passing through the workpiece 11.

Figure 6:
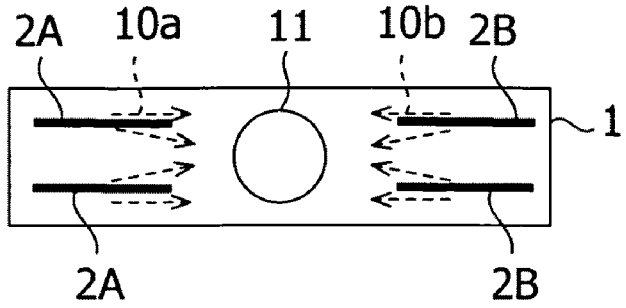
FIG. 6 is a schematic plan view showing a layout of a cathode plate in accordance with a fourth embodiment of the present invention.

Also, FIG. 6 shows a fourth embodiment in which a plurality of (four) cathode plates 2A and 2B are arranged in parallel so as to be separated from each other on both sides of the workpiece 11 with the workpiece 11 being held therebetween. In the case in which the cathode plates 2 are arranged in parallel on both sides of the workpiece 11 in this manner as well, there are a mode in which the flows 10*a* and 10*b* of treatment solution directed to the workpiece 11 are generated and a mode in which the flow 10*a* of treatment solution directed from one side of the treatment tank 1 to the other side thereof passing through the workpiece 11 is generated.

Figure 7:
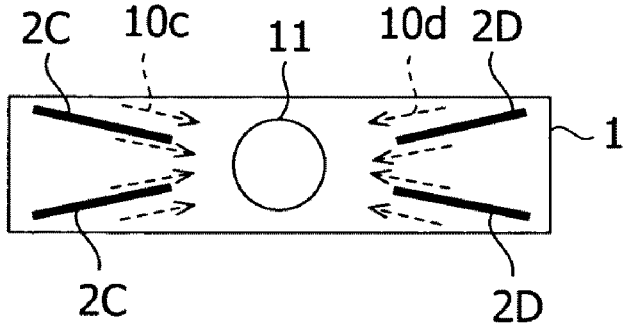
FIG. 7 is a schematic plan view showing a layout of a cathode plate in accordance with a fifth embodiment of the present invention.
Figure 8:
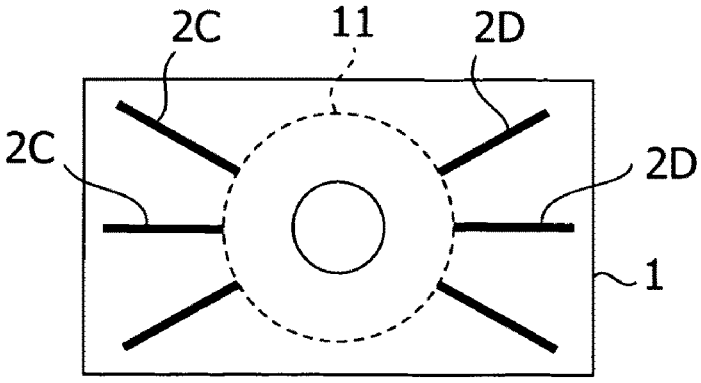
FIG. 8 is a schematic plan view showing another example of a layout of a cathode plate in accordance with a fifth embodiment of the present invention.

FIGS. 7 and 8 show a fifth embodiment in which a plurality of (four and six) cathode plates 2C and 2D are arranged radially with respect to the workpiece 11. This arrangement of the cathode plates 2 is suitable for generating flows 10*c* and 10*d* of treatment solution directed to the workpiece 11 along the cathode plates 2. The treatment solution arriving at the workpiece 11 is circulated to the upper part or the lower part of the treatment tank 1.

Figure 9:
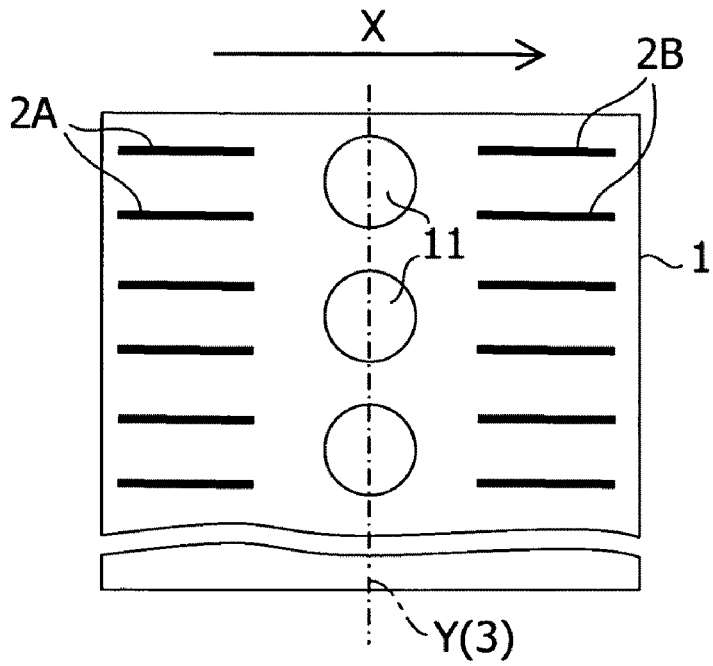
FIG. 9 is a schematic plan view showing a layout of a cathode plate in accordance with a sixth embodiment of the present invention.

FIG. 9 is a schematic plan view showing an embodiment suitable for the case in which a plurality of workpieces 11, each having a relatively small size (for example, a piston of internal combustion engine) are treated at the same time. In this embodiment, the plurality of workpieces 1I1 are arranged in a row and are supported by the support 3, and on the other hand, the cathode plates 2A and 2B are oriented to the direction crossing the direction Y in which the workpieces 11 are arranged, and are arranged substantially in parallel so as to be separated from each other on both sides of the workpieces 11 with the workpieces 11 being held therebetween.

By adopting such a layout, the electrode areas of the cathode plates 2A and 2B can be increased further effectively. In addition, the equipment installation space can be utilized effectively in the case where a large number of workpieces 11 supported collectively by the rack-shaped support 3 are conveyed in the direction X perpendicular to the arrangement direction Y together with the support 3 to perform processes of degreasing, cleaning, and the like, and an advantage that the conveyance distance is shortened is offered. Also, depending on the number and shape of the workpieces 11, the configuration can be such that the workpieces 11 are conveyed in the arrangement direction Y together with the support 3 to be subjected to other processes.

Although omitted in the drawings, in the embodiment shown in FIG. 9 as well, as in the above-described embodiments, there are a mode in which the flows (10*a* and 10*b* in FIG. 4) of treatment solution directed to the workpieces 11 are generated and a mode in which the flows (10*a*, 10*a* in FIG. 5) of treatment solution directed from one side of the treatment tank 1 to the other side thereof passing through the workpiece 11 is generated.

Also, in the example shown in FIG. 9, the cathode plates 2A and 2B are arranged so as to cross the side projected surfaces of the workpieces 11. However, depending on the size and shape of the workpieces 11, the cathode plates 2A and 2B may be arranged so as to shift in the Y direction from the arrangement of the workpieces 11. Further more, in the case of a general-purpose anodizing apparatus, which treats any parts other than specific parts, even if the arrangement intervals between the cathode plates 2A and 2B and the workpieces 11 do not have a relationship such as to be a simple integer ratio, electric charges necessary and sufficient for anodization are supplied to the workpieces 11, so that uniform film properties can be treated if the cathode plates 2A and 2B are oriented in a direction so as to cross the arrangement direction Y of the workpieces 11. In this case, it is preferable that flows of treatment solution facing the workpieces 11 be generated.

Figure 10:
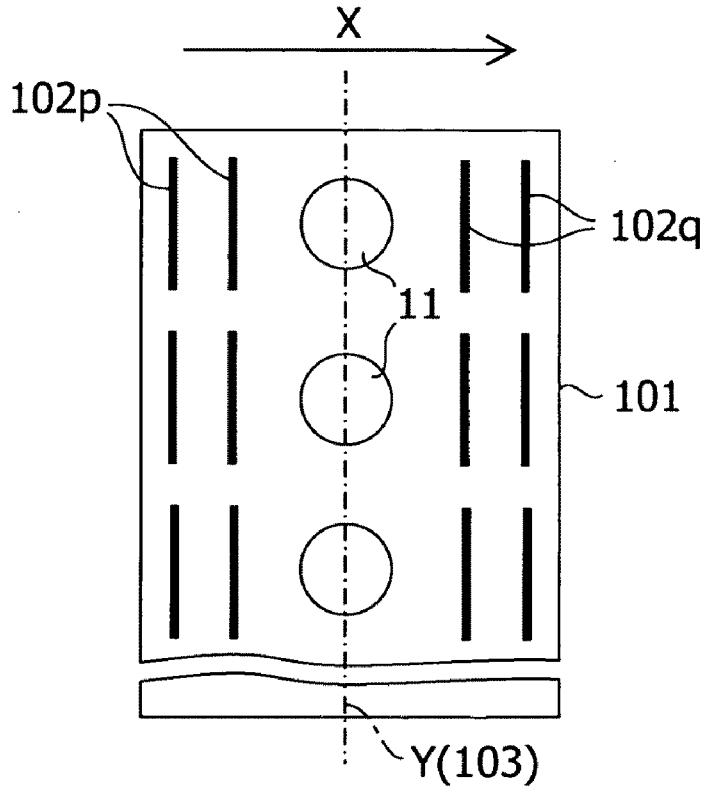
FIG.10 (RELATED ART)
FIG. 10 is a schematic plan view showing a layout of a cathode plate of a comparative example.

FIG. 10 shows a case where two cathode plates 102*p* and 102*q* are arranged so as to face to both sides of the workpieces 11 with the workpieces 11 being held therebetween as comparative example of the above-described embodiments. In such a layout, the size in the conveyance direction X is shortened, but large intervals between the workpieces 11 must be provided because the cathode plates 102*p* and 102*q* are arranged in the arrangement direction Y. Therefore, as more workpieces are to be treated at the same time, the width of a treatment tank 101 increases, which poses a problem in that a support 103 is increased in the length. Further more, a serious problem as described below arises. Of the two cathode plates 102*p* and 102*q* on each side, the cathode plate separate from the workpiece 11 is obstructed by the cathode plate close to the workpiece 11, and the back surface of the cathode plate close to the workpiece 11 also provides a surface opposite to the workpiece 11, so that the fact that the contribution to the substantial increase in electrode area is small has been confirmed by experimentally, as described later.

Figure 11:
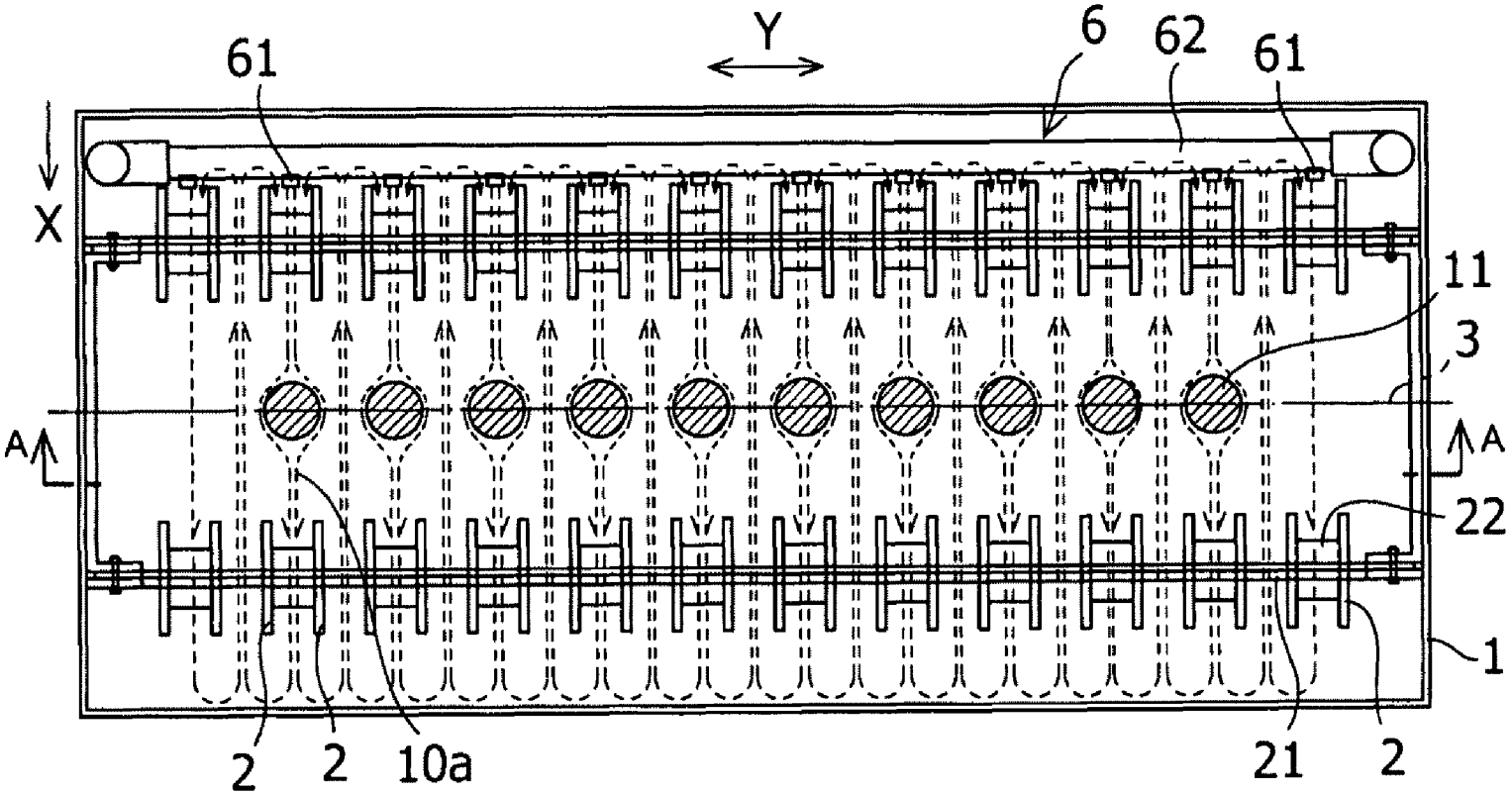
FIG. 11 is a plan view of an anodizing apparatus in accordance with an embodiment of the present invention.
Figure 12:
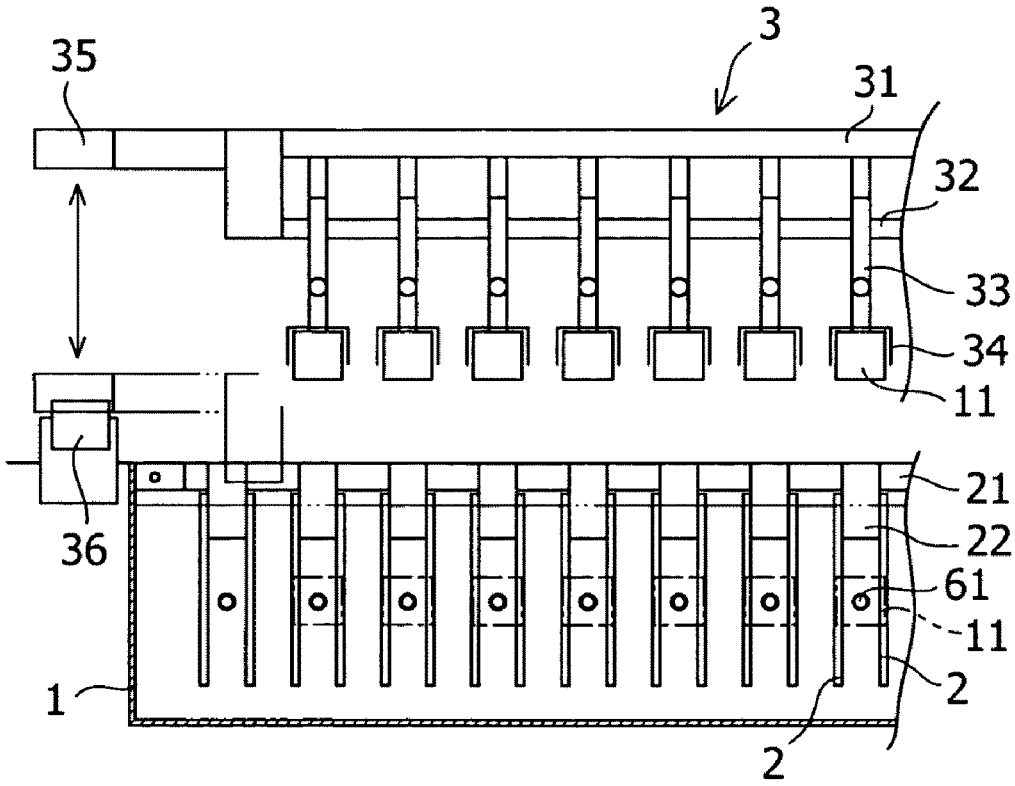
FIG. 12 is a sectional view taken along the line A-A of FIG. 11.

FIGS. 11 and 12 show an embodiment of an anodizing apparatus for a piston of an automobile engine, based on the above-described embodiment shown in FIG. 9. In FIGS. 11 and 12, two support beams 21 are installed in parallel in the upper part of the treatment tank 1, and the cathode plates 2 are fixed to brackets 22 provided in parallel along the lengthwise directions of the support beams 21 in such a manner that the two plates form one set.

In the embodiment shown in FIGS. 11 and 12, on both sides of ten workpieces 11 (pistons) disposed in the treatment tank 1 in a state of being supported by the support 3 in such a manner as to be arranged in a row, twenty-four (a total of forty-eight) cathode plates 2 are arranged in parallel so as to be oriented to a direction perpendicular to the arrangement direction Y. Excluding a total of eight cathode plates 2 in the side end parts, four cathode plates 2 are disposed with respect to one workpiece 11.

The support 3 is made up of a support frame formed by a main support beam 31 and a subsidiary support beam 32 extendingly provided in parallel with the main support beam 31 under the main support beam 31 and ten support members 33 suspended from the support frame at predetermined intervals. In the lower end part of each of the support members 33, a locking means (chuck, clamp, hook, etc.) for locking the workpiece 11 and a cover 34 (masking) for covering non-treated parts of the workpiece 11 are provided. The cover 34 has a function of preventing the treatment solution from intruding into the inside of the piston, which is the workpiece 11. In the case more the whole of the workpiece 11 is immersed in the treatment solution, a mechanism for tilting the support members 33 all together can be provided additionally to drain the treatment solution accumulated in the workpiece 11 after treatment.

On the other hand, on both outer sides of the treatment tank 1, a detachably supporting part 36 for supporting an end part 35 of the support 3 (the main support beam 31) lowered to the treatment position at which anodization is accomplished is provided. The end part 35 and the detachable supporting part 36 each are provided with a contact that touches in the state in which the support 3 is supported to establish a current carrying path to the workpiece 11, so that the support 3 is electrically connected to the power supply unit via the contact.

Also, a piping 62 for sending the treatment solution under pressure is provided so as to extend along the inside wall of the treatment tank 1, and the piping 62 has nozzles 61 for spraying the treatment solution, which are provided so as to face to the workpieces 11 supported at the treatment positions by the support members 33, by which an agitating means 6 for the treatment solution is formed. The piping 62 is connected to an overflow pipe of the treatment tank 1 via a pump, not shown, on the outside of the treatment tank 1. Therefore, by applying a pressure to the treatment solution, which is sucked through the overflow pipe, with a pump and by spraying it from the nozzles through the piping 62, there can be formed a circulation flow of treatment solution that goes toward the workpiece 11, passing through the workpiece 11, and reaches the cathode plate 2 on the opposite side.

Thus, by making a plurality of cathode plates 2 correspond to one workpiece 11, even in the state in which the workpieces 11 are arranged efficiently in the treatment tank 1 so as to be provided in parallel at relatively small intervals, the electrode area can be increased significantly, and a large current can be supplied without increasing the sizes of the treatment tank 1 and the support 3. The cathode plates 2 have functions not only of interrupting the flow of treatment solution but also of straightening the flow of treatment solution as a straightening plate, so that the improvement in treatment quality due to the improvement in agitation and cooling effect of treatment solution can also be anticipated. Also, the electrode area can further be enlarged in the X direction (conveyance direction) perpendicular to the arrangement direction Y of the workpiece 11.

Figure 13:
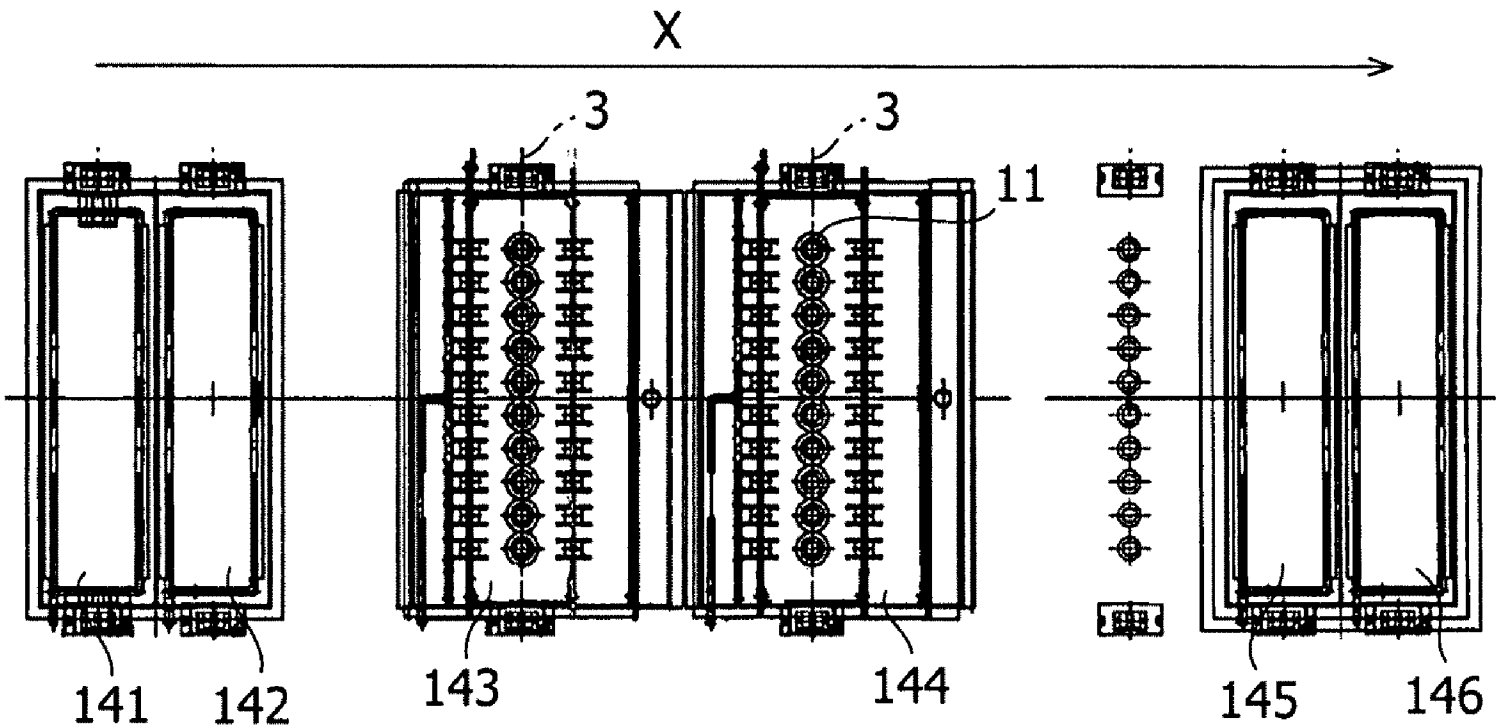
FIG. 13 is a plan view showing a flow of treatment in a treatment facility including an anodizing apparatus in accordance with an embodiment of the present invention.

FIG. 13 shows an example of a treatment facility in which a degreasing tank 141, a water washing tank 142, primary and secondary anodizing tanks 143 and 144, a water washing tank 145, and a hot-water washing tank 146 are arranged in the named order along the conveyance direction X in which the workpieces 11 are conveyed together with the support 3. The support 3 is conveyed along the conveyance distance X by a conveyance system, not shown, and the conveyance system is additionally provided with an elevating device, not shown, that lowers the support 3 to set the workpieces 11 in each treatment tank and to pull up the workpieces 11 from each treatment tank.

Next, the effect of anodization based on the above-described embodiment is verified by experimental data.

In the experiment, a treatment tank in which two cathode plates were provided on each side of ten pistons made of aluminum alloy (AC8A) in a crossover layout as shown in FIG. 9 (FIG. 11), and anodizing treatment was performed for 4 minutes by using 10 vol % of sulfuric acid as the treatment solution and by applying an input voltage of 40 V and a charge removal voltage of −2 V of bipolar pulse voltage at a period of 50 μs as shown in Table 1.

TABLE 1

| | Example of present invention | Comparative example 1 | Comparative example 2 |
|---|---|---|---|
| Cathode | Crossover type | Facing type | Facing type |
| Treatment solution | Sulfuric acid 10 vol % | Sulfuric acid 10 vol % | Sulfuric acid 15 vol % |
| Treatment temperature | 10° C. | 10° C. | 0-5° C. |
| Treatment time | 4 minutes | 4 minutes | 20 minutes |
| Input voltage | 40 V | 40 V | About 80 V max. (Constant-current control) |
| Voltage application time/period | 50 μs | 50 μs | — |
| Charge removal voltage | −2 V | −2 V | — |
| Average current (Instantaneous current) | 156 A (720 Ap) (Instantaneously, 42 times of the direct current) | 146 A (675 Ap) | 17 A (3 A/10000 $mm^2$) (Constant current) |
| Average film thickness | 11.8 μm | 7.3 μm | 8.7 μm |

TABLE 1-continued

| | Example of present invention | Comparative example 1 | Comparative example 2 |
|---|---|---|---|
| Difference between max. film thickness and min. film thickness | 5.4 μm | 11.8 μm | 26.8 μm |
| (Max. film thickness value − min. film thickness value)/ average film thickness | 0.5 | 1.6 | 3.1 |

Also, as comparative examples, an experiment (comparative example 1) in which anodizing treatment was performed by using a treatment tank in which two cathode plates having the same shape were provided on each side in a facing layout as shown in FIG. 10 and by applying a bipolar pulse voltage that was the same as described above and an experiment (comparative example 2) in which direct-current anodizing treatment was performed for 20 minutes by applying a DC voltage to the cathode plates arranged in the facing layout similar to that in comparative example 1 were conducted, and the cross sections of the anodized films were photographed to compare the film properties.

Figure 14:
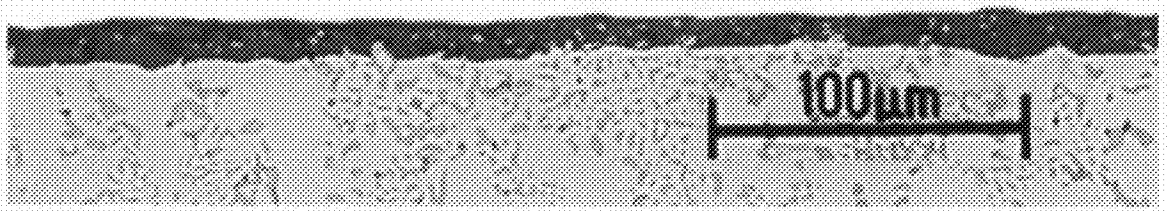
FIG. 14 is a cross-sectional photograph of an anodized film of an example of the present invention.
Figure 15:
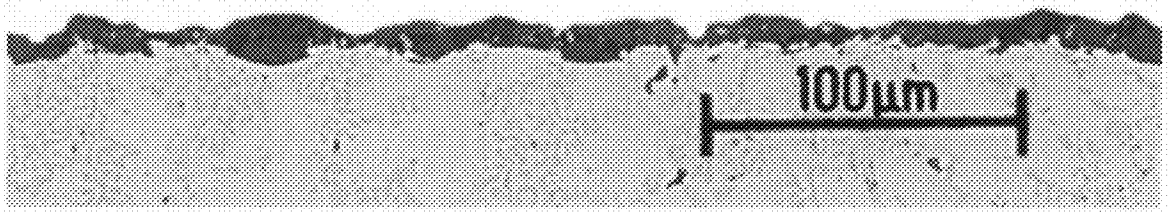
FIG. 15 (RELATED ART)
FIG. 15 is a cross-sectional photograph of an anodized film of a comparative example 1.
Figure 16:
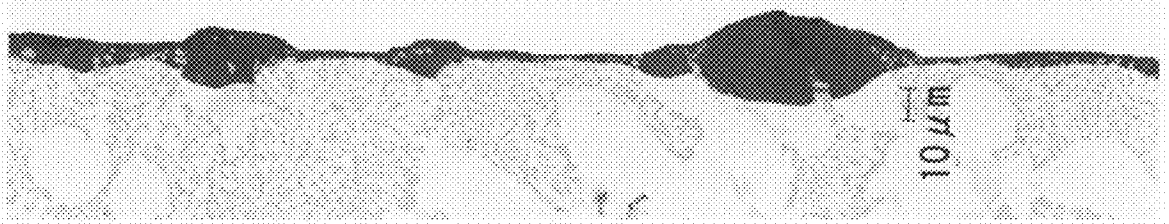
FIG. 16 (RELATED ART)
FIG. 16 is a cross-sectional photograph of an anodized film of a comparative example 2.

FIG. 14 shows the cross section of the anodized film of the example of present invention, and FIGS. 15 and 16 show the cross sections of the anodized films of comparative examples 1 and 2, respectively. To judge the film properties, an average film thickness (μm) was determined by dividing the cross-sectional area of film in the cross-sectional photographs of FIGS. 14 to 16 by the transverse width. Also, a difference (μm) between the maximum film thickness and the minimum film thickness was measured on the cross-sectional photographs, and the ratio of the difference between the maximum film thickness and the minimum film thickness to the average film thickness was determined as smoothness.

The smoothness of the anodized film produced by the crossover layout of example of present invention was 0.5. This value is a third or less the smoothness of the anodized film produced by the direct-current anodization of comparative example 2. It is found that both of average film thickness and smoothness are improved despite the short treatment time. Also, the smoothness of the anodized film of the example of present invention is a half or less the smoothness of the anodized film produced by the facing layout of comparative example 1 in which the same bipolar pulse voltage was applied, which indicates that the electrode arrangement in which a surface opposite to the workpiece is provided contributes little to the substantial increase in electrode area.

The above is a description of an embodiment of the present invention. The present invention is not limited to the above-described embodiment, and various modifications and changes can further be made based on the technical concept of the present invention.

For example, in the above-described embodiment, there has been shown the case in which the treatment in which the anodization accomplished by the application of positive voltage for a very short period of time and the removal of film charges are repeated, that is, the anodizing treatment performed by applying a bipolar pulse voltage of short period is performed. However, the present invention is not limited to this case. Depending on the conditions, the present invention can also be applied to a case in which treatment is performed by applying a positive voltage intermittently for a very short period of time, that is, anodizing treatment is performed by applying a unipolar pulse voltage of a short period or a case in which anodizing treatment is performed by applying a high-frequency alternating voltage. The former case in which anodizing treatment is performed by the unipolar pulse voltage is a case in which only the film charge removal time (interval) is set and the film charge removal voltage is zero, that is, a case in which the charge removal is not accomplished positively.

Also, the above-described embodiment has shown the case in which the present invention is applied to the treatment of pistons of internal combustion engines. However, the present invention can be applied to various articles made of aluminum or aluminum alloy, including cylinders of internal combustion engines and hydraulic and pneumatic pistons and cylinders. The layout of the cathode plates 2, 2A, 2B, 2C and 2D of the above-described embodiments can be adopted selectively or combinedly according to the workpiece. Also, in the case of a large article or the like, the cathode plate may be oriented in a direction such that the cathode plate crosses the workpiece or the arrangement direction thereof so as to have a tilt angle.

What is claimed is:

1. An anodizing apparatus for forming an anodized film on the surface of a workpiece made of aluminum or aluminum alloy, comprising:

a treatment tank for containing an electrolytic solution;

at least one cathode plate disposed in the treatment tank;

a supporting means for supporting the workpiece so as to be immersed in the electrolytic solution; and a power supply for continuously or intermittently applying a short-period bipolar or unipolar pulse voltage or an alternating voltage to between the workpiece and the cathode plate, wherein the at least one cathode plate is arranged in a crosswise direction with respect to the workpiece such that the electrode surface of the cathode plate does not face the workpiece.

2. The anodizing apparatus according to claim 1, wherein the at least one cathode plate is arranged in plurality so as to be substantially parallel spaced.

3. The anodizing apparatus according to claim 1, wherein the at least one cathode plate is arranged in both directions with respect to the workpiece.

4. The anodizing apparatus according to claim 1, wherein the at least one cathode plate is arranged in plurality so as to be radial with respect to the workpiece.

5. The anodizing apparatus according to claim 2, wherein the workpiece is arranged in plurality and is supported by the supporting means, and the at least one cathode plate is oriented to the direction crossing the arrangement direction of the workpieces and are disposed substantially in parallel so as to be separated from each other.

6. The anodizing apparatus according to claim 1, wherein the apparatus further comprises a means for generating a flow of the electrolytic solution in the treatment tank, the flow being directed to the workpiece along the at least one cathode plate.

7. The anodizing apparatus according to claim 3, wherein the workpiece is arranged in plurality and is supported by the supporting means, and the at least one cathode plate is oriented to the direction crossing the arrangement direction of the workpieces and are disposed substantially in parallel so as to be separated from each other.

8. The anodizing apparatus according to claim 2, wherein the apparatus further comprises a means for generating a flow of the electrolytic solution in the treatment tank, the flow being directed to the workpiece along the at least one cathode plate.

9. The anodizing apparatus according to claim 3, wherein the apparatus further comprises a means for generating a flow of the electrolytic solution in the treatment tank, the flow being directed to the workpiece along the at least one cathode plate.

10. The anodizing apparatus according to claim 4, wherein the apparatus further comprises a means for generating a flow of the electrolytic solution in the treatment tank, the flow being directed to the workpiece along the at least one cathode plate.

* * * * *